US007314352B2

(12) United States Patent
Nakayoshi et al.

(10) Patent No.: US 7,314,352 B2
(45) Date of Patent: Jan. 1, 2008

(54) ELECTRIC PUMP

(75) Inventors: Hideki Nakayoshi, Kariya (JP); Atsutoshi Ikegawa, Nagoya (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 379 days.

(21) Appl. No.: 11/059,326

(22) Filed: Feb. 17, 2005

(65) Prior Publication Data

US 2005/0186089 A1 Aug. 25, 2005

(30) Foreign Application Priority Data

Feb. 23, 2004 (JP) ..... 2004-047019
Dec. 9, 2004 (JP) ..... 2004-357000

(51) Int. Cl.
*F04B 17/00* (2006.01)

(52) U.S. Cl. ..... 417/356; 417/321; 417/355; 417/410.4; 417/423.14; 417/423.15

(58) Field of Classification Search ..... 417/321, 417/349, 355, 410.4, 423.7, 356, 423.14, 417/423.15

See application file for complete search history.

(56) References Cited

U.S. PATENT DOCUMENTS

| | | | | |
|---|---|---|---|---|
| 2,711,286 | A * | 6/1955 | McAdam | 417/356 |
| 2,871,793 | A | 2/1959 | Michie et al. | |
| 4,384,828 | A * | 5/1983 | Rembold et al. | 417/356 |
| 5,219,276 | A * | 6/1993 | Metzner et al. | 417/356 |
| 5,952,746 | A * | 9/1999 | Mittmann et al. | 310/42 |
| 6,065,946 | A | 5/2000 | Lathrop | |
| H1966 | H * | 6/2001 | Henry et al. | 417/356 |
| 6,585,498 | B2 * | 7/2003 | Arbogast et al. | 417/423.1 |
| 2004/0219035 | A1 * | 11/2004 | Hundt et al. | 417/368 |

FOREIGN PATENT DOCUMENTS

| | | |
|---|---|---|
| DE | 196 27 668 A1 | 7/1996 |
| DE | 100 33 405 A1 | 7/2000 |
| JP | 62-067286 | 9/1985 |
| JP | 02-277983 | 4/1989 |
| JP | 11-343983 | 5/1998 |
| JP | 2003-129966 | 10/2001 |

* cited by examiner

*Primary Examiner*—Devon C. Kramer
*Assistant Examiner*—Leonard J Weinstein
(74) *Attorney, Agent, or Firm*—Reed Smith LLP; Stanley P. Fisher, Esq.; Juan Carlos A. Marquez, Esq.

(57) ABSTRACT

An electric pump comprises a case in which a core being enwound by a coil is embedded, a permanent magnet formed in a cylindrical shape, having a central axis being identical to that of the core, and positioned so as to face an inner peripheral side of the core, an outer rotor fixed to an inner peripheral side of the permanent magnet, a rotor unit including the permanent magnet and the outer rotor, an inner rotor having a central axis, which is eccentric from a central axis of the core, so as to rotate; and an inscribed-type pump for carrying out, by means of rotation of the inner rotor, which is engaged with the outer rotor so as to rotate in accordance with rotation of the outer rotor, intake and exhaust of fluids, wherein the rotor unit includes a slide surface extending in an axial direction; the case includes a cylindrical projecting ring portion having an identical central axis to that of the core, and the rotor unit is rotatably supported by the peripheral surface of the cylindrical projecting ring portion at the slide surface.

14 Claims, 6 Drawing Sheets

ELECTRIC PUMP

This application is based on and claims priority under 35 U.S.C. § 119 to Japanese Patent Application 2004-047019 filed on Feb. 23, 2004 and Japanese Patent Application 2004-357000 filed on Dec. 9, 2004. The entire content of them is incorporated herein by reference.

FIELD OF THE INVENTION

The present invention generally relates to an electric pump having an inscribed-type pump.

BACKGROUND

A known electric pump is disclosed, for example, in JP2003129966A. In the electric pump, a motor portion (MT), having a configuration of a brushless motor, is used for driving the pump portion (PM) so as to prevent short-circuits due to a usage of fluid (e.g. hydraulic oil).

Further, in the electric pump, an inscribed-type pump is used as the pump portion, and such the inscribed-type pump is positioned inside the motor portion so as to downsize the electric pump in an axial direction. Specifically, a core of the motor portion is embedded in a housing, and a permanent magnet, which faces the core in contiguity therewith, is supported so as to rotate relative to the same axis as that of the core. An outer rotor of the pump portion is fixed at the permanent magnet so as to rotate integrally therewith. An inner rotor, having a central axis eccentric from a central axis of the core or the like, is supported within the outer rotor. In this circumstance, within the motor portion, the inner rotor rotates in accordance with the rotation of the outer rotor (and the permanent magnet) so as to carry out intake and exhaust of fluid.

According to the know electric pump, the permanent magnet fixed to the outer rotor slides on an inner peripheral surface of the housing at which the core is embedded. In this circumstance, the inner peripheral surface of the housing, which is molded by use of resin, or the outer peripheral surface of the permanent magnet wears so as to decrease the duration of life thereof.

Thus, a need exist for an electric pump having an inscribed-type pump to expand the duration of life thereof.

SUMMARY OF THE INVENTION

According to an aspect of the present invention, a electric pump comprises a case in which a core being enwound by a coil is embedded, a permanent magnet formed in a cylindrical shape, having a central axis being identical to that of the core, and positioned so as to face an inner peripheral side of the core, an outer rotor fixed to an inner peripheral side of the permanent magnet, a rotor unit including the permanent magnet and the outer rotor, an inner rotor having a central axis, which is eccentric from a central axis of the core, so as to rotate; and an inscribed-type pump for carrying out, by means of rotation of the inner rotor, which is engaged with the outer rotor so as to rotate in accordance with rotation of the outer rotor, intake and exhaust of fluids, wherein the rotor unit includes a slide surface extending in an axial direction; the case includes a cylindrical projecting ring portion having an identical central axis to that of the core, and the rotor unit is rotatably supported by the peripheral surface of the cylindrical projecting ring portion at the slide surface.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

First Embodiment

Figure 1A:
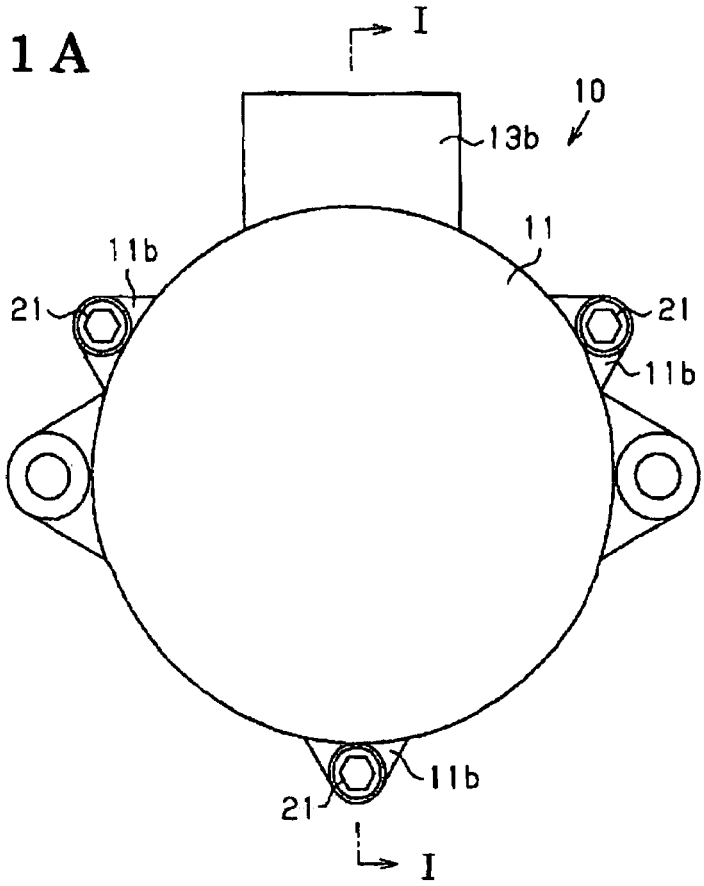
FIG. 1A illustrates a front view of the first embodiment according to the present invention.

The first embodiment of an electric oil pump according to the present invention will be explained with reference to FIG. 1A and FIG. 1B. FIG. 1A illustrates a front view of an electric oil pump 10, and FIG. 1B illustrates a cross section of FIG. 1A along a I-1 line.

Figure 1B:
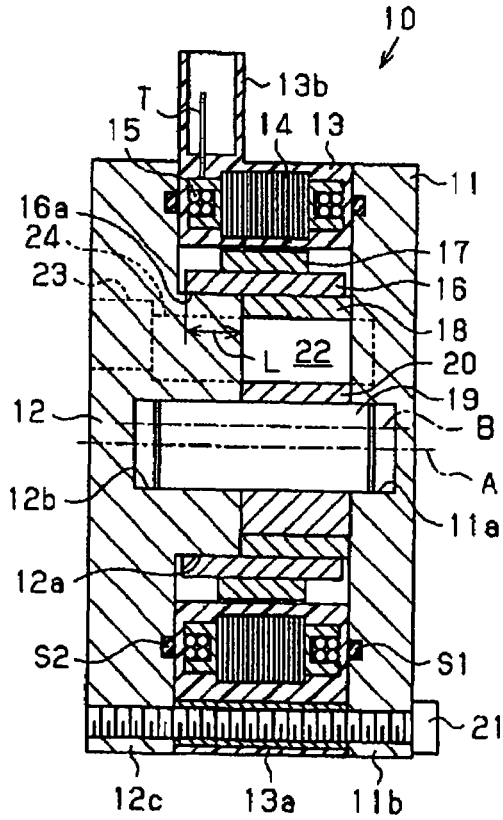
FIG. 1B illustrates a cross section of FIG. 1A along an I-I line.

As shown in FIG. 1A and FIG. 1B, a case of the electric oil pump 10 includes a cover 11, a housing 12 and a stator 13, which is sandwiched between the cover 11 and the housing 12.

The cover 11, made of aluminum or the like, is formed so as to be in approximately a disc form and includes a central axis B. A round-shaped recessed hole 11*a* is formed on one surface of the cover 11. The recessed hole 11*a* includes a central axis A, which is eccentric from the central axis B of the cover 11. On the cover 11, a plurality of bracket portions 11*b* (e.g. three bracket portions 11*b*) is formed so as to extend radially at predetermined angles.

The housing 12, made of aluminum or the like and formed so as to be in approximately a disc form, includes an outside diameter, which is identical to the outside diameter of the cover 11. The housing 12 includes a stepped portion on one side thereof (on the right side in FIG. 1B, which faces the cover 11), so as to form a cylindrical projecting ring portion 12*a*, which is of approximately a cylindrical shape, and has a smaller diameter than that of the housing 12. A central axis of the housing 12 is with the central axis B. A round-shaped recessed hole 12*b* is formed on the cylindrical projecting ring portion 12*a* of the housing 12. The recessed hole 12*b* hole has a central axis, which corresponds to the central axis A, and has an inside diameter, which is identical to the inside diameter of the hole 11*a*. On the housing 12, a plurality of bracket portions 12*c* (e.g. three bracket portions 12*c*) is formed so as to extend radially at predetermined angles, each of which corresponds to the each of the bracket portions 11*b*.

The stator 13, which is made of resin and formed so as to be in approximately cylindrical, has an outside diameter, which is identical to the outside diameter of the cover 11 (and the housing 12), and has an inside diameter, which is larger than the outside diameter of the cylindrical projecting ring portion 12*a*. The stator 13 extends in an axial direction so as to be longer than a length of the cylindrical projecting ring portion 12*a* in an axial direction. The stator 13 includes a central axis, which is identical to the central axis B, and is sandwiched between the cover 11 and the housing 12.

Specifically, on the stator 13, a plurality of bracket portions 12*c* (e.g. three bracket portions 12*c*) is formed so as to extend radially at predetermined angles, each of which corresponds to the each of the bracket portions 11*b* and 12*c*.

The stator 13 is sandwiched between the cover 11 the housing 12, each of bolts 21 (e.g. three bolts in this embodiments) is inserted from each of the bracket portions 11*b* through each of the bracket portions 13*a*, and screwed at each of the bracket portions 12*c*. In this condition in which the stator 13 is held between the cover 11 and the housing 12, the outer peripheral surface (peripheral surface) of the cylindrical projecting ring portion 12*a* is surrounded through a predetermined space in a radial direction by the inner peripheral surface of the stator 13.

The stator 13 is engaged with the cover 11 at a ring-shaped contact surface thereof, and a groove in a round shape, which has the same center point as the contact surface of the cover 11, is formed on the contact surface of the cover 11. A ring-shaped sealing S1, such as an O-ring, is fit into the groove.

In the same manner, the stator 13 is engaged with the housing 12 at a ring-shaped contact surface thereof, and a groove in a round shape, which has the same center point as the contact surface of the housing 12, is formed on the contact surface of the housing 12. A ring-shaped sealing S2, such as an O-ring, is fit into the groove. In this circumstances, an inside of the case of the electric oil pump 10, which comprises three different elements (cover 11, housing 12 and stator 13), is sealed.

The stator 13 is a part of the motor portion (brushless motor) includes the core 14, in which a plurality of approximately circular-ring-shaped steel plates is laminated in an axial direction, and a coil 15, by which the core 14 is enwound. The core 14 and the coil 15 are inserts molded so as to form the stator 13. The coil 15 is electrically connected to a plurality of contact terminals T, which extends in a radial direction toward the outside of the electric oil pump 10.

A connector holder 13*b* is integrally formed at the stator 13, so as to surround the contact terminals T.

By means of the connector holder 13*b*, an external connector (not shown), which is electrically connected to a motor driver portion (not shown), can be mounted to the electric oil pump 10. Power is applied to the coil 15 by means of the external connector through the contact terminal T so as to generate rotating magnetic field. Because the coil 15 or the like is insert-molded by use of resin, which forms the outer shape of the stator 13, a short-circuit due to a usage of fluid (e.g. hydraulic oil) can be prevented.

The stator 13 houses a back yoke 16 and a permanent magnet 17, which are a part of the motor portion, and an outer rotor 18, a shaft 19 and an inner rotor 20, which are a part of the pump portion.

The back yoke 16 is formed so as to be in a cylinder shape. Specifically, an inside diameter of the back yoke 16 is identical to the outside diameter of the cylindrical projecting ring portion 12*a*, and a length in an axial direction of the back yoke 16 is slightly shorter than the length in an axial direction of the stator 13.

Specifically, the inner peripheral surface of the back yoke 16 includes a slide surface 16*a*, which extends in an axial direction (in leftward in FIG. 1A) from a point, which corresponds to the end surface of the cylindrical projecting ring portion 12*a*, at a distance L The back yoke 16 is inserted into the cylindrical projecting ring portion 12*a* so as to be rotatably supported by the cylindrical projecting ring portion 12*a* at the slide surface 16*a*.

The permanent magnet 17, which is formed in a cylinder shape, is attached to the outer peripheral surface of the back yoke 16 in a condition in which the permanent magnet 17 faces the core 14 in a radial direction. A space is provided between the inner peripheral surface of the stator 13 and the permanent magnet 17. The permanent magnet 17 includes north poles and south poles, which are provided one after the other in a circumferential direction. The permanent magnet 17 is driven so as to rotate by means of the rotating magnetic field of the coil 15.

The outer rotor 18, which is formed in a drum shape, includes an outside diameter, which is identical to the inside diameter of the back yoke 16, and a length in an axial direction, which is identical to a distance between the cover 11 and the end surface of the cylindrical projecting ring portion 12*a*.

The outer rotor 18 is provided between the cover 11 and the cylindrical projecting ring portion 12*a* so as to be fit into the inside of the back yoke 16. Thus, the back yoke 16 includes a slide surface 16*b*, which extends in an axial direction (in leftward in FIG. 1A) from a point, which corresponds to the end surface of the outer rotor 18, at a distance L. Because the outer rotor 18 is provided between the housing 12 and the cover 11. The outer rotor 18 is an outer rotor of the inscribed type (trochoid type) pump, which is a pump portion, and rotates integrally with the back yoke 16 and the permanent magnet 17. The central axes of the back yoke 16, the permanent magnet 17 and the outer rotor 18, which rotate integrally together, are identical to the central axis B of the stator 13 or the like. The back yoke 16 is provided between the permanent magnet 17 and the outer rotor 18 so as to prevent magnetization on the outer rotor 18.

The shaft 19, which is formed in approximately a cylindrical-column shape, includes an outside diameter, which is identical to the inside diameter of the holes 11*a* and 12*b*, into which shafts are inserted. One end of the shaft 19 is fit into the hole 11*a*, and another end of the shaft 19 is fit into the hole 12*b* so as to maintain the shaft 19. Thus, the central axis of the shaft 19 is identical to the central axis A, which is eccentric from the central axis B. An inner rotor 20, which constitutes the inscribed type (trochoid type) pump, is rotatably supported by the shaft 19 in a condition in which the inner rotor 20 is engaged with the outer rotor 18. The length of the inner rotor 20 in an axial direction is identical to the length of the outer rotor 18 in an axial direction. Thus, a closed space 22 is formed between the cover 11 and the housing 12 (the cylindrical projecting ring portion 12*a*) in a condition in which the outer surface of the inner rotor 20 is engaged with the inner surface of the outer rotor 18. Because the central axis A of the inner rotor 20 is eccentric from the central axis B of the outer rotor 18 in a radial direction, the inner rotor 20 rotates depending on the rotation of the outer rotor 18.

In such configuration, an inlet 23, which is concaved so as to be in parallel with an axial direction (central axis B), and an intake port 24, which is concaved so as to form a groove on an end surface of the cylindrical projecting ring portion 12*a* are formed on the housing 12. The intake port 24 connects to the inlet 23, which further connects to a fluid container (e.g. oil pan, reservoir). In accordance with the rotation of the outer rotor 18 and the inner rotor 20, which dependently rotates with the outer rotor 18, the intake port 24 intakes fluid to a closed space 22, to which the intake port 24 opens.

In the same manner, an exhaust hole, which is concaved so as to be in parallel with an axial direction, and an exhaust port, which is concaved so as to form a groove on an end surface of the cylindrical projecting ring portion 12*a* are formed on the housing 12. The exhaust port connects to the exhaust hole. In this embodiment, the exhaust hole and the exhaust port are not illustrated in the drawings because the exhaust hole has the same structure as that of the inlet 23, and the exhaust port has the same structure as that of the intake port 24, except these positions, which are different in circumferential direction of the shaft 19. Thus, in accordance with the rotation of outer rotor 18 and the inner rotor 20 that dependently rotates with the outer rotor 18, the fluid, which is intake into the closed space 22, is exhausted through the exhaust port to the object (e.g. an automatic transmission and an engine on a vehicle).

In this circumstance, in accordance with the rotation of outer rotor 18 and the inner rotor 20 that dependently rotates with the outer rotor 18, the electric oil pump 10 intakes fluid from the fluid container into the closed space 22 through the inlet 23 and the intake port 24, and then the intake fluid is exhausted to the object (e.g. an automatic transmission and an engine on a vehicle) through the exhaust port and the exhaust hole. Because the slide surface 16*a* of the back yoke 16, which is fixed to the outer rotor 18, slides on the outer peripheral surface (peripheral surface) of the cylindrical projecting ring portion 12*a*, it is prevented that the permanent magnet 17 slides on the inner peripheral surface of the stator 13.

A general actuation of the electric oil pump 10 will be explained as follows. A power is supplied from an external connector to the electric oil pump 10 through the contact terminal T so as to actuate the electric oil pump 10, and then the coil 15 generates a rotating magnetic field. At this point, a rotation force because of the rotating magnetic field in circumferential direction is generated at the permanent magnet 17. Because of the rotation force, the permanent magnet 17 rotates along with the back yoke 16 and the outer rotor 18.

In accordance with the rotation of outer rotor 18 and the inner rotor 20, which dependently rotates with the outer rotor 18, the electric oil pump 10 intakes fluid from the fluid container into the closed space 22 through the inlet 23 and the intake port 24, and the intake fluid is exhausted to the object (e.g. an automatic transmission and an engine on a vehicle) through the exhaust port and the exhaust hole.

As described above, according to this embodiment, following effects can be obtained.

(1) According to this embodiment, the back yoke 16 is rotatably supported at the slide surface 16*a* to the outer peripheral surface (peripheral surface) of the cylindrical projecting ring portion 12*a*. Thus, in accordance with the rotation of the outer rotor 18, the permanent magnet 17 indirectly slides on the inner peripheral surface of the stator 13, in which the core 14 is embedded, and thus, the case and the permanent magnet 17 are prevented from wearing so as to expand the duration of life thereof.

(2) According to this embodiment, the cylindrical projecting ring portion 12*a* (housing 12), to which the back yoke 16 is rotatably supported, is made of aluminum so as to enhance the wear resistance. Further, when the wear on the cylindrical projecting ring portion 12*a* is reduced, blurrings of the axes of the back yoke 16, the permanent magnet 17 and the outer rotor 18 can also be reduced.

(3) According to this embodiment, there is no necessity to consider the wear on the inner peripheral surface of the stator 13, which is made of resin, as a result, the thickness of a resin portion between the core 14 and the inner peripheral surface of the stator 13 can be reduced. In this circumstance, the permanent magnet 17 can be positioned closer to the core 14 so as to enhance the efficiency of the motor portion.

(4) According to this embodiment, the back yoke 16 is provided between the permanent magnet 17 and the outer rotor 18 so as to prevent the outer rotor 18 from magnetization. In this circumstance, it can be prevented that foreign compound such as iron powder is attached to the outer rotor 18.

(5) According to this embodiment, the outer rotor 18 and the inner rotor 20, which constitute the pump portion (inscribed-type pump), are positioned within the motor portion (the back yoke 16 and the permanent magnet 17) so as to downsize the electric oil pump 30 in an axial direction.

Second Embodiment

The second embodiment of the electric oil pump according to the present invention will be explained in accordance with the cross section shown in FIG. 2. In the second embodiment, the cover and the stator in the first embodiment are integrally molded, and the back yoke is rotatably supported at the outer peripheral surface thereof to the housing. The second embodiment basically has a similar structure to those of the first embodiment, and the emphasis will be placed on an explanation of differences from the first embodiment.

Figure 2:
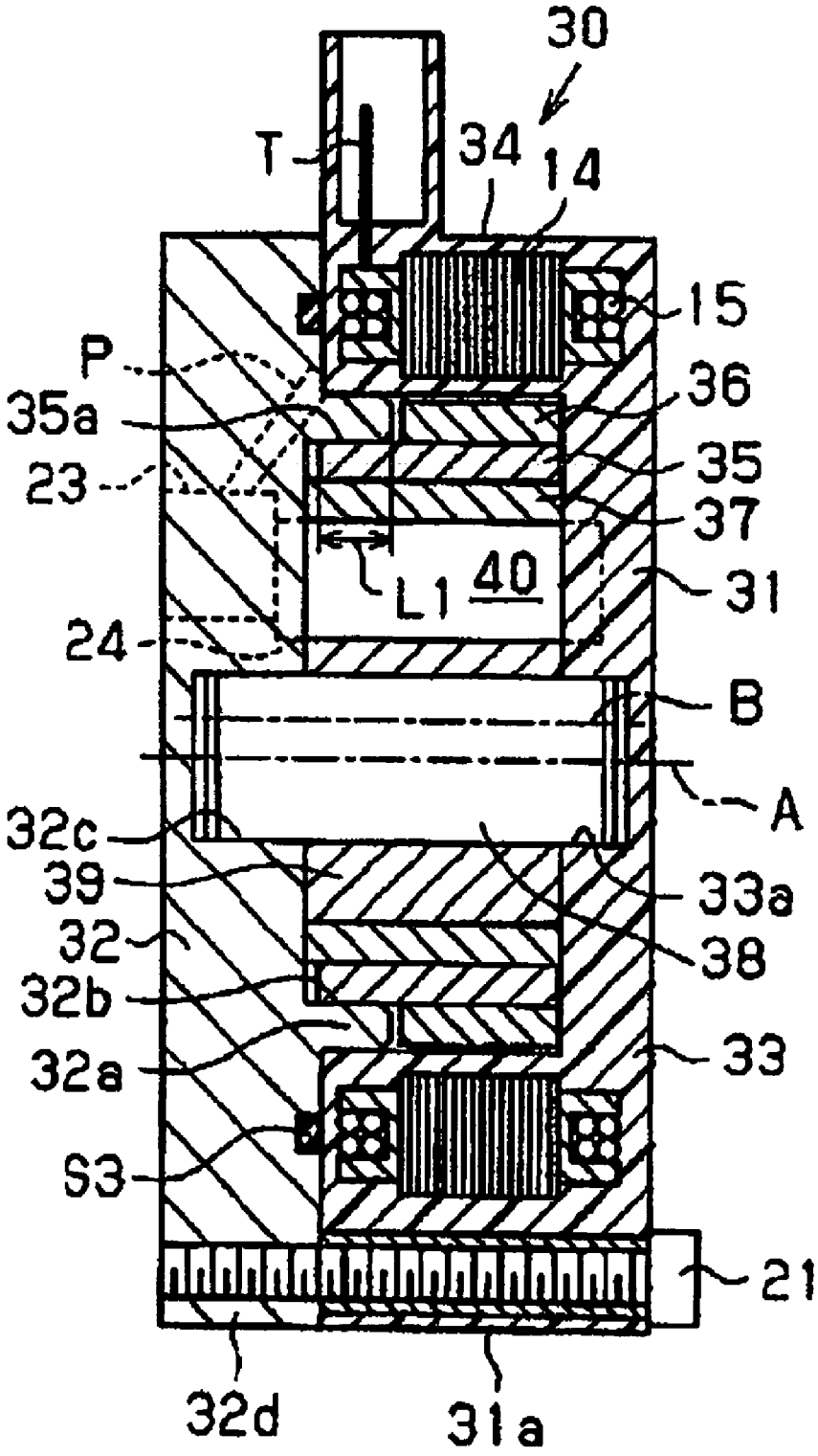
FIG. 2 illustrates a cross section of the second embodiment according to the present invention.

As shown in FIG. 2, the case of an electric oil pump 30 of this embodiment includes a stator housing 31 and a housing 32, which is connected to the stator housing 31.

The stator housing 31 is formed by used of resin so as to be in a having-a-bottom cylinder shape. On a bottom portion 33 of the stator housing 31, a hole 33*a* is formed. The hole 33*a*, which is concaved so as to be in a round shape, includes a central axis A, which is eccentric from the central axis B of the stator housing 31. Specifically, the stator housing 31 includes a drum portion 34, which extends from a peripheral portion of the bottom portion 33, into which the core 14 is embedded. The coil 15 is enwound to the core 14.

More specifically, the drum portion 34 constructs a part of the motor portion. A plurality of bracket portions 31*a*, each of which extends in a radial direction at a predetermined angle, is formed on the drum portion 34 of the stator housing 31.

The housing 32, made of aluminum or the like and formed so as to be in approximately a disc form, includes an outside diameter, which is identical to the outside diameter of the stator housing 31. The housing 32 includes a stepped portion on one side thereof (on the right side in FIG. 2, which faces the stator housing 31), so as to form a cylindrical projecting ring portion 32*a*, which is of approximately a cylindrical shape and has an outer diameter which is identical to an inner diameter of the stator housing 31 (drum portion 34).

The length of the cylindrical projecting ring portion 32*a* in an axial direction is set to be shorter than the length of the drum portion 34 in an axial direction. A hollow cylindrical portion 32*b*, which is concaved in a round shape, is partially defined by the inner peripheral surface of the cylindrical projecting ring portion 32*a*. In other words, the hollow cylindrical portion 32*b* includes the inner peripheral surface of the cylindrical projecting ring portion 32*a* as its own inner peripheral surface.

A central axis of the housing 32 (the cylindrical projecting ring portion 32*a* and the hollow cylindrical portion 32*b*) is identical to the central axis B. The recessed hole 32*c* is formed in a round shape so as to be concaved, which has a central axis being identical to the central axis A, and has an inside diameter, which is identical to the inside diameter of the hole 33*a*. On the housing 32, a plurality of bracket portions 32*d* (e.g. three bracket portions 32*d*) is formed so as to extend radially at predetermined angles, each of which corresponds to the each of the bracket portions 32*d*.

The housing 32 is fixed to the stator housing 31 in a condition in which the cylindrical projecting ring portion 32*a* is inserted into the drum portion 34 of the stator housing 31, and then each of bolts 21 is inserted from each of the bracket portions 31*a* and screwed at each of the bracket portions 32*d*.

The housing 32 is engaged with the stator housing 31 (drum portion 34) at a ring-shaped contact surface thereof, and a groove in a round shape, which has the same center point as the contact surface of the housing 32, is formed on the contact surface of the housing 32. A ring-shaped sealing S3, such as an O-ring, is fit into the groove. In this circumstances, an inside of the case of the electric oil pump 10, which comprises two different elements (the housing 32 and the stator housing 31), is sealed.

The drum portion 34 of the stator housing 31 includes a back yoke 35 and a permanent magnet 36, which are a part of the motor portion, and an outer rotor 37, a shaft 38 and an inner rotor 39, which are a part of the pump portion.

The back yoke 35 is formed so as to be in a cylinder shape. Specifically, an outside diameter of the back yoke 35 is identical to the inside diameter of the hollow cylindrical portion 32*b*, and a length in an axial direction of the back yoke 35 is identical to the length in an axial direction of the drum portion 34.

Specifically, the outer peripheral surface of the back yoke 35 includes a slide surface 35*a*, which extends in an axial direction (in leftward in FIG. 2) from a point, which corresponds to the bottom surface of the hollow cylindrical portion 32*b*, at a distance L1. The back yoke 35 is inserted into the hollow cylindrical portion 32*b* so as to be rotatably supported by the hollow cylindrical portion 32*b* at the slide surface 35*a*.

While the back yoke 35 is rotatably supported, on the side of the cylindrical projecting ring portion 32*a*, a space is formed by means of the outer peripheral surface of the back yoke 35 and the inner peripheral surface of the drum portion 34.

The space faces the core 14 in a radial direction, and the permanent magnet 36 is fixed to the outer peripheral surface of the back yoke 35, which corresponds to the space. A space is formed between the inner peripheral surface of the drum portion 34 and the permanent magnet 36, which is of a cylindrical shape. Thus, the slide surface 35*a* is formed on the outer peripheral surface of the back yoke 35, which extends towards the permanent magnet 36 in an axial direction.

The permanent magnet 36 rotates in accordance with the rotating magnetic field of the coil 15, and the back yoke 35 rotates on the hollow cylindrical portion 32*b* along with the permanent magnet 36.

The outer rotor 37, which is formed in a drum shape, includes an outside diameter, which is identical to the inside diameter of the back yoke 35, and a length in an axial direction, which is identical to a length of the drum portion 34 in an axial direction. The outer rotor 37 rotatably contacts a bottom surface of the hollow cylindrical portion 32*b* at an end surface of the outer rotor 37. The outer rotor 37 is provided between the stator housing 31 (bottom portion 33) and the housing 32 so as to be fit into the inside of the back yoke 35. The outer rotor 37, which is an outer rotor of the inscribed type (trochoid type) pump, rotates integrally together with the back yoke 35 and the permanent magnet 36.

The shaft 38, which is formed in approximately a cylindrical-column shape, includes an outside diameter, which is identical to the inside diameter of the holes 33*a* and 32*c*, into which shafts are inserted. One end of the shaft 38 is fit into the hole 33*a*, and another end of the shaft 38 is fit into the hole 32*c* so as to maintain the shaft 38. An inner rotor 39, which constitutes the inscribed type (trochoid type) pump, is rotatably supported by the shaft 38 in a condition in which the inner rotor 39 is engaged with the outer rotor 37. The length of the inner rotor 39 in an axial direction is identical to the length of the outer rotor 37 in an axial direction.

Thus, a closed space 40 is formed between the bottom portion 33 of the stator housing 31 and the housing 32 in a condition in which the outer surface of the inner rotor 39 is engaged with the inner surface of the outer rotor 37. Because the central axis A of the inner rotor 39 is eccentric from the central axis B of the outer rotor 37 in a radial direction, the inner rotor 39 rotates depending on the rotation of the outer rotor 37.

Because the actuation of the electric oil pump 30 in accordance with the rotation of the outer rotor 37 and the rotation of the inner rotor 39 is same as the actuation of the electric oil pump 10 in the first embodiment, the explanation of the actuation of the electric oil pump 30 will be skipped in the second embodiment.

As shown in FIG. 2, an oil path P is provided in the electric oil pump 30, through which high-pressure fluid, which is retained within the electric oil pump 30, is returned to the intake side (inlet 23), through a space, which is formed by the drum portion 34 and the permanent magnet 36. Because of the oil path P, the motor portion is cooled by the circulation of the fluid retained within the electric oil pump 30, and foreign substances can be prevented from being stuck within the electric oil pump 30.

As described above, according to this embodiment, following effects can be obtained in addition to the effects (3)-(5) described in the first embodiment.

(1) According to the second embodiment, the back yoke 35 is rotatably supported by the peripheral surface of the hollow cylindrical portion 32*b* at the slide surface 35*a*. Thus, while the outer rotor 37 rotates, the permanent magnet 36 is not engaged with the inner peripheral surface of the drum portion 34 in which the core is embedded. The drum portion 34 and the permanent magnet 36 can be prevented from wearing so as to expand the duration of life thereof.

(2) According to the second embodiment, the hollow cylindrical portion 32*b* (housing 32), to which the back yoke 35 is rotatably supported, is made of aluminum, so as to improve the wear resistance thereof. When the wear on the hollow cylindrical portion 32*b* is reduced, blurring of the axes of the back yoke 35, the permanent magnet 36 and the outer rotor 37 can also be reduced.

Third Embodiment

The third embodiment of the electric oil pump according to the present invention will be explained in accordance with the cross section shown in FIG. 3. In the third embodiment, the outer rotor in the second embodiment is rotatably supported at the outer peripheral surface thereof to the housing. The third embodiment basically has a similar structure to those of the second embodiment, and the emphasis will be placed on an explanation of differences from the second embodiment.

Figure 3:
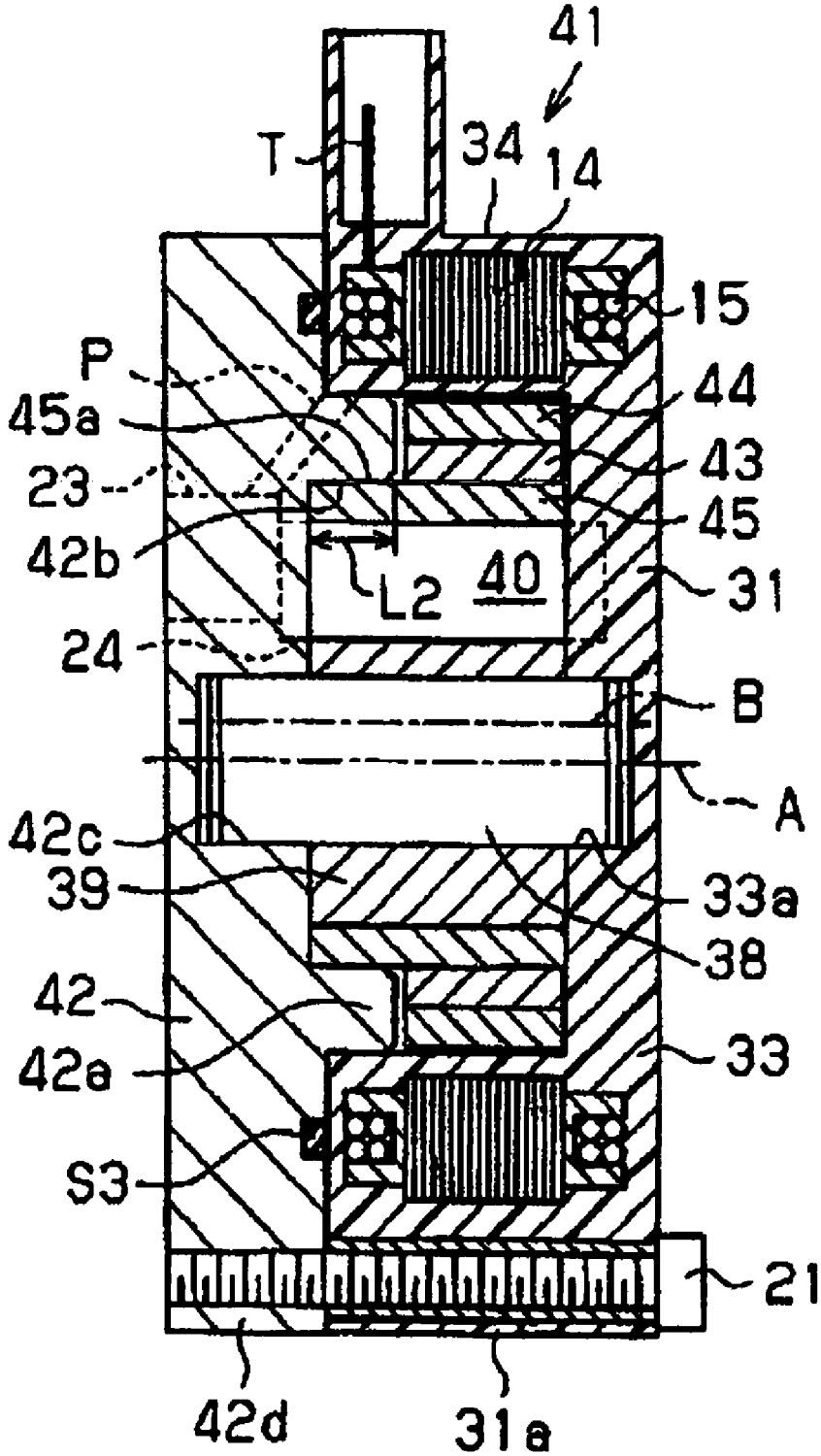
FIG. 3 illustrates a cross section of the third embodiment according to the present invention.

As shown in FIG. 3, the case of an electric oil pump 41 of the third embodiment includes a stator housing 31 and a housing 42, which is connected to the stator housing 31.

The housing 42, made of aluminum or the like and formed so as to be in approximately a disc form, includes an outside diameter, which is identical to the outside diameter of the stator housing 31. The housing 42 includes a stepped portion on one side thereof (on the right side in FIG. 3, which faces the stator housing 31), so as to form a cylindrical projecting ring portion 42*a*, which is of approximately a cylindrical shape and has an outer diameter which is identical to an inner diameter of the stator housing 31 (drum portion 34).

The length of the cylindrical projecting ring portion 42*a* in an axial direction is set to be shorter than the length of the drum portion 34 in an axial direction. A hollow cylindrical portion 42*b*, which is concaved in a round shape, is partially defined by the inner peripheral surface of the cylindrical projecting ring portion 42*a*.

A central axis of the housing 42 (cylindrical projecting ring portion 42*a* and hollow cylindrical portion 42*b*) is identical to the central axis B. The recessed hole 42*c* is formed in a round shape so as to be concaved, which has a central axis being identical to the central axis A, and has an inside diameter, which is identical to the inside diameter of the hole 33*a*. On the housing 42, a plurality of bracket portions 42*d* is formed so as to extend radially at predetermined angles, each of which corresponds to the each of the bracket portions 31*a*.

The housing 42 is fixed to the stator housing 31 in a condition in which the cylindrical projecting ring portion 42*a* is inserted into the drum portion 34 of the stator housing 31, and then each of bolts 21 is inserted from each of the bracket portions 31*a* and screwed at each of the bracket portions 42*d*.

The drum portion 34 of the stator housing 31 includes a back yoke 43 and a permanent magnet 44, which are a part of the motor portion, and an outer rotor 45, a shaft 38 and an inner rotor 39, which are a part of the pump portion.

The outer rotor 45 is formed so as to be in a cylinder shape. Specifically, an outside diameter of outer rotor 45 is identical to the inside diameter of the hollow cylindrical portion 42*b*, and a length in an axial direction of the outer rotor 45 is identical to the length in an axial direction of the drum portion 34.

Specifically, the outer peripheral surface of the outer rotor 45 includes a slide surface 45*a*, which extends in an axial direction (in leftward in FIG. 3) from a point, which corresponds to the end surface of the cylindrical projecting ring portion 42*a*, at a distance L2. The outer rotor 45 is inserted into the hollow cylindrical portion 42*b* so as to be rotatably supported by the hollow cylindrical portion 42*b* at the slide surface 45*a*. The outer rotor 45 is an outer rotor, which constitutes an inscribed type (trochoid type) pump.

While the outer rotor 45 is rotatably supported, on the end side of the cylindrical projecting ring portion 42*a*, a space is formed by means of the outer peripheral surface of the outer rotor 45 and the inner peripheral surface of the drum portion 34.

The space faces the core 14 in a radial direction, and the cylindrical back yoke 43 is fixed to the outer peripheral surface of the outer rotor 45, which corresponds to the space. The permanent magnet 44 is fixed to the outer peripheral surface of the back yoke 43, which corresponds to the space.

Thus, the slide surface 45*a* is formed on the outer peripheral surface of the outer rotor 45, which extends towards the permanent magnet 44 in an axial direction. The slide surface 45*a* rotates on the hollow cylindrical portion 42*b*. A space is provided between the inner peripheral surface of the drum portion 34 and the permanent magnet 44, which is formed in a cylinder shape. The permanent magnet 44 rotates in accordance with the rotating magnetic field of the coil 15.

Because the configurations of the shaft 38 and the inner rotor 39 supported to the shaft 38, and the actuation of the electric oil pump 41 in accordance with the rotation of the outer rotor 45 and the inner rotor 39 are same as these of the second embodiment, the explanation of these configurations of the shaft 38 and the inner rotor 39 and the actuation of the electric oil pump 41 will be skipped in this embodiment.

As described above, according to the third embodiment, following effects can be obtained in addition to the effects (3)-(5) described in the first embodiment.

(1) According to the third embodiment, the outer rotor 45 is rotatably supported by the inner peripheral surface of the hollow cylindrical portion 42*b* at the slide surface 45*a*. Thus, while the outer rotor 45 rotates, the permanent magnet 44 is not engaged with the inner peripheral surface of the drum portion 34 in which the core 14 is embedded. The drum portion 34 and the permanent magnet 44 can be prevented from wearing so as to expand the duration of life thereof.

(2) According to the third embodiment, the hollow cylindrical portion 42*b* (housing 42), to which the outer rotor 45 is rotatably supported, is made of aluminum, so as to improve the wear resistance thereof. When the wear on the hollow cylindrical portion 42*b* is reduced, blurring of the axes of the back yoke 43, the permanent magnet 44 and the outer rotor 45 can also be reduced.

Fourth Embodiment

The fourth embodiment of the electric oil pump according to the present invention will be explained in accordance with drawings shown in FIG. 4A and FIG. 4B. In the fourth embodiment, the motor driver portion in the first embodiment is integrated in the case. The fourth embodiment basically has a similar structure to those of the first embodiment, and the emphasis will be placed on an explanation of differences from the first embodiment.

Figure 4A:
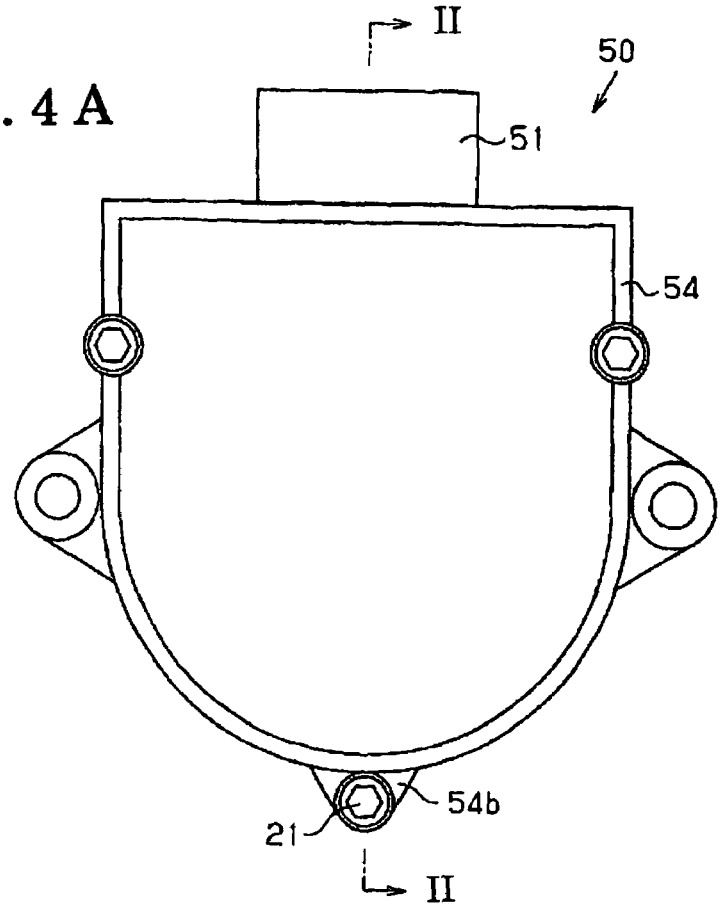
FIG. 4A illustrates a front view of the fourth embodiment according to the present invention.
Figure 4B:
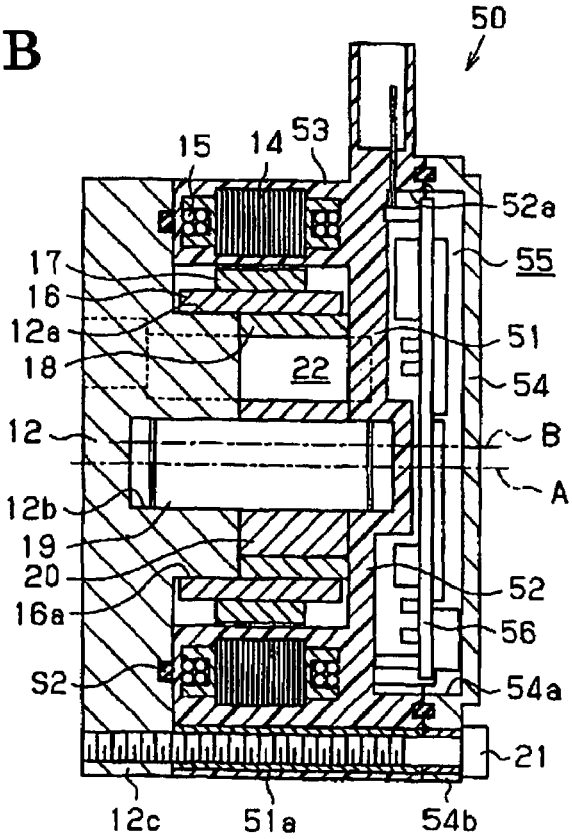
FIG. 4B illustrates a cross section of FIG. 4A along an II-II line.

FIG. 4A illustrates a front view of the electric oil pump 50, and FIG. 4B illustrates a cross section along a II-II line in FIG. 4A. As shown in FIG. 4B, the case of an electric oil pump 50 of the fourth embodiment includes a stator housing 51, a cover 54 and a housing 12.

The stator housing 51 is formed by used of resin so as to be in a having-a-bottom cylinder shape. On one side of a bottom portion 52 of the stator housing 51 (on a right side in FIG. 4B), a hollow cylindrical portion 52*a* is formed so as to be concaved to the housing 12 side.

Specifically, the stator housing 51 includes a drum portion 53, which extends from a peripheral portion of the bottom portion 52, into which the core 14 is embedded. The coil 15 is enwound around the core 14.

More specifically, the drum portion 53 constructs a part of the motor portion. A plurality of bracket portions 51*a*, each of which extends in a radial direction at a predetermined angle, is formed on the drum portion 53 of the stator housing 51.

On the cover 54, which is made of aluminum, a hollow cylindrical portion 54*a* is formed so as to be concaved toward the hollow cylindrical portion 52*a*. Further, on the cover 54, bracket portions 54*b* are formed so as to extend in accordance with the bracket portion 51*a*.

The stator housing 51 is sandwiched between the cover 54 and the housing 12 in a condition in which the each of bolts 21 is inserted from each of the bracket portions 54*b* through each of the bracket portions 51*a*, and screwed at each of the bracket portions 12*c*.

A closed space 55 is formed between the hollow cylindrical portion 52*a* and the hollow cylindrical portion 54*a*. A motor driver portion 56 is housed in a closed space 55. A structure, in which the back yoke 16, the permanent magnet 17, the outer rotor 18, the shaft 19 and the inner rotor 20 are surrounded by the drum portion 53, is the same as the structure in the first embodiment. Because an actuation of the electric oil pump 50 caused by the rotation of the inner rotor 20 and the rotation of the outer rotor 18 is the same as the actuation of the electric oil pump 10 in the first embodiment, an explanation of the electric oil pump 50 in the fourth embodiment will be skipped.

As described above, according to the fourth embodiment, following effects can be obtained in addition to the effects described in the first embodiment.

(1) According to this embodiment, the motor driver portion 56 is housed in the space 55 formed between the stator housing 51 and the cover 54 so as to integrate the motor driver portion 56 and the electric oil pump 50. In this configuration, a space and a cost can be reduced comparing to the electric oil pump in which the motor driver portion is mounted independently.

Fifth Embodiment

The fifth embodiment of the electric oil pump according to the present invention will be explained in accordance with the cross section shown in FIG. 5. In the fifth embodiment, a cylindrical projecting ring portion, which is similar to the cylindrical projecting ring portion formed on the housing 12, is formed on the cover 11. The fifth embodiment basically has a similar structure to those of the first embodiment, and the emphasis will be placed on an explanation of differences from the first embodiment.

Figure 5:
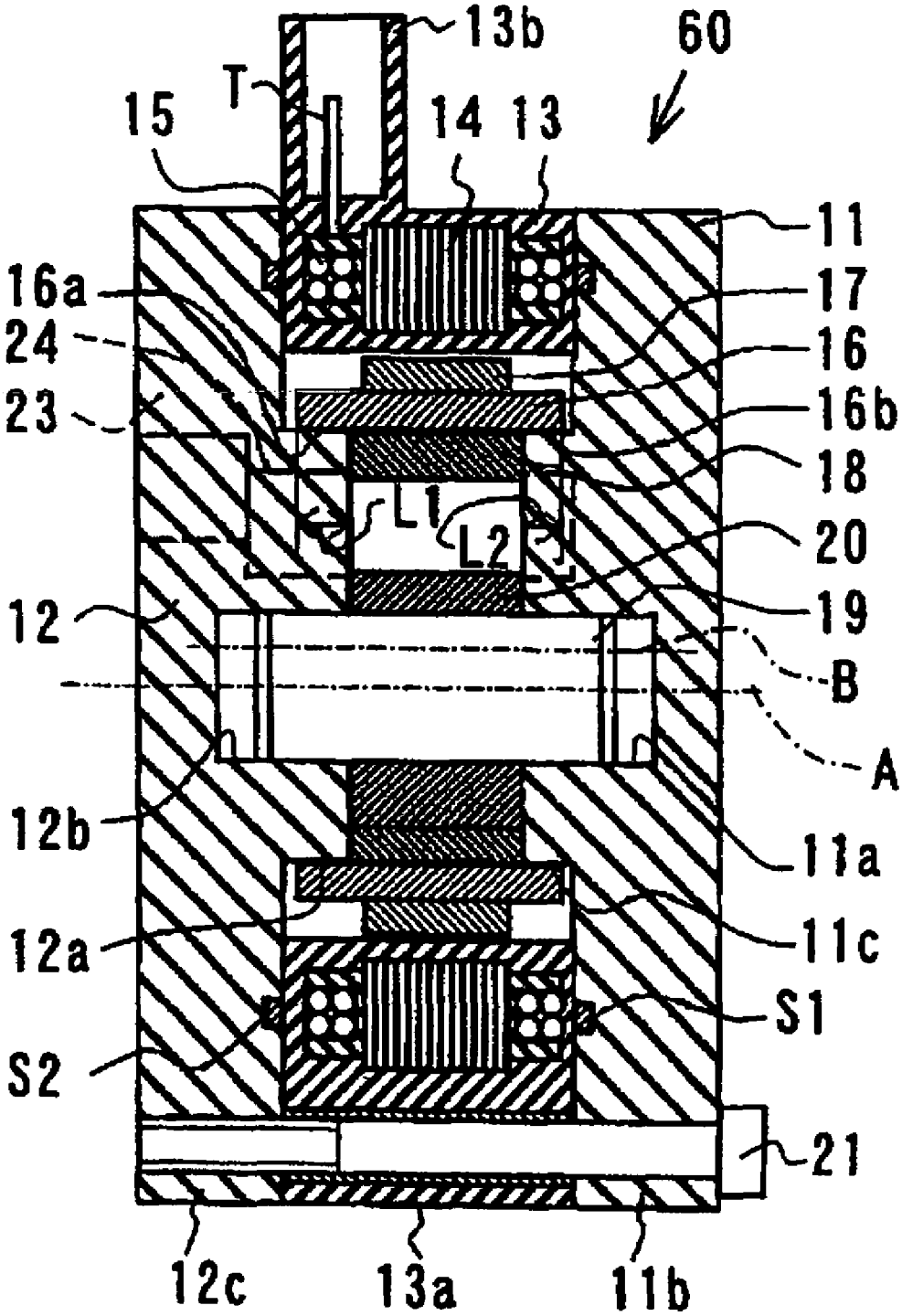
FIG. 5 illustrates a cross section of the fifth embodiment according to the present invention.

As shown in FIG. 5, a case of an electric oil pump 60 in the fifth embodiment includes a cover 11, a housing 12 and a stator 13 sandwiched between the housing 12 and the cover 11.

The cover 11 includes a stepped portion on one side thereof (on the left side in FIG. 5 which faces the housing 12), so as to form a cylindrical projecting ring portion 11*c*, which is in approximately a cylindrical-column shape.

The housing 12 includes a stepped portion on one side thereof (on the right side in FIG. 5 which faces the cover 11), so as to form a cylindrical projecting ring portion 12*a*, which is approximately cylindrical.

The stator 13 houses a back yoke 16 and a permanent magnet 17, which are a part of the motor portion, and an outer rotor 18, a shaft 19 and an inner rotor 20, which are a part of the pump portion.

The back yoke 16 is formed so as to be in a cylinder shape. Specifically, an inside diameter of the back yoke 16 is identical to the outside diameter of cylindrical projecting ring portion 11*c* and the cylindrical projecting ring portion 12*a*, and a length in an axial direction of the back yoke 16 is slightly shorter than the length in an axial direction of the stator 13.

Specifically, the inner peripheral surface of the back yoke 16 includes a slide surface 16*a* and a slide surface 16*b*. The slide surface 16*a* extends in an axial direction from a point, which corresponds to the end surface of the cylindrical projecting ring portion 12*a*, at a distance L1, and the slide surface 16*b* extends in an axial direction from a point, which corresponds to the end surface of the cylindrical projecting ring portion 11*c*, at a distance L2. The back yoke 16 is inserted into the cylindrical projecting ring portion 12*a* and the cylindrical projecting ring portion 11*c* so as to be rotatably supported at the slide surface 16*a* and the slide surface 16*b*.

As described above, according to the fifth embodiment, following effects can be obtained in addition to the effects described in the first embodiment.

(1) According to the fifth embodiment, the back yoke 16 is rotatably supported at both the slide surface 16*a* and the slide surface 16*b* so as to reduce blurring on the back yoke 16, the permanent magnet 17 and the outer rotor 18.

Sixth Embodiment

Figure 6:
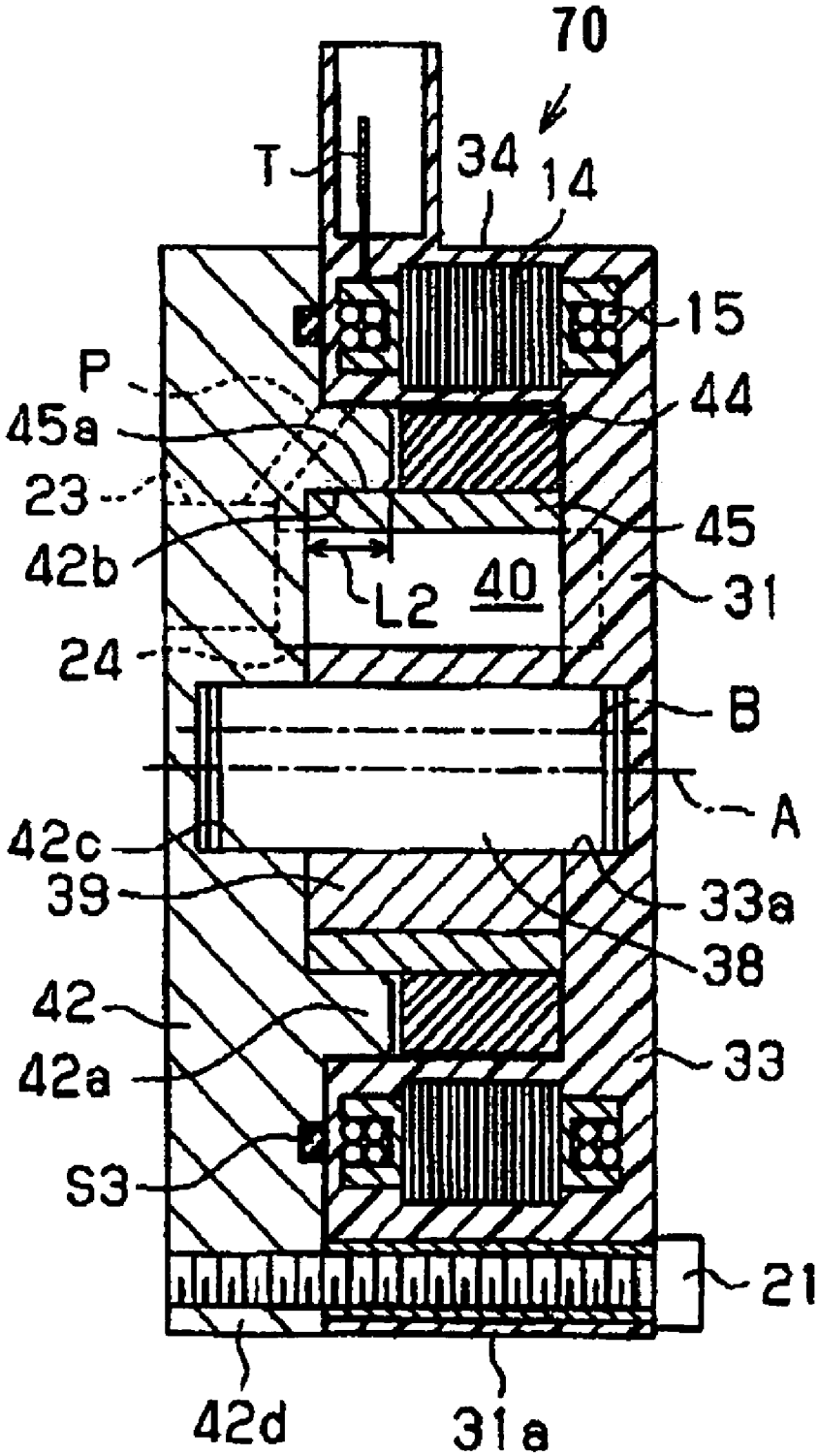
FIG. 6 illustrates a cross section of the sixth embodiment according to the present invention.

The sixth embodiment of the electric oil pump according to the present invention will be explained in accordance with the cross section shown in FIG. 6. The sixth embodiment basically has a similar structure to those of the third embodiment. Differences from the third embodiment are that the back yoke 43 is not provided the electric oil pump in the sixth embodiment, and the outer rotor 45 is directly attached to the permanent magnet 44.

According to the sixth embodiment, following effects can be obtained in addition to the effects described in the third embodiment.

(1) According to the sixth embodiment, a space, in which the back yoke 43 is provided, can be used for housing a thick permanent magnet. By means of such the thick permanent magnet, an output motor drive or a pump performance can be enhanced.

The above embodiments may be changed as follows.

- In the first embodiment, the cylindrical projecting ring portion 12*a* is formed on the housing 12, however, a cylindrical projecting ring portion, which is similar to the cylindrical projecting ring portion 12*a*, may be formed on the cover 11.
- In the second and the third embodiments, the hollow cylindrical portions 32*b* and 42*b* are formed on the peripheral surface of the cylindrical projecting ring portions 32*a* and 42*a*. However, the bottom portions of the housings 32 and 42 may be concaved in an axial direction so as to form hollow cylindrical portions.
- In the first, the second and the third embodiments, the motor driver portion may be integrated to the case.
- A shaft, at which the inner rotor is fixed, is rotatably supported by a hole formed on the case.
- The case of the electric oil pump may not be formed with plural components (two or three). The case may be formed as a single component.
- The core 14 to which the coil 15 is enwound may not be embedded into the case, which is molded by use of resin. In other words, the core 14 to which the coil 15 is enwound may be housed within the case even when the case is completely sealed.
- The inscribed-type pump, including the outer rotor and the inner rotor, is used in the above embodiments, however, an internal gear pump may be used alternatively.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. An electric pump of inscribed-type comprising:

a case in which a core being enwound by a coil is embedded;

a permanent magnet formed in a cylindrical shape, having a central axis being identical to that of the core, and positioned so as to face an inner peripheral side of the core;

an outer rotor fixed to an inner peripheral side of the permanent magnet;

a rotor unit including the permanent magnet and the outer rotor; and an inner rotor having a central axis which is eccentric from a central axis of the core and the inner rotor engaged with the outer rotor so as to rotate in accordance with rotation of the outer rotor, thereby carrying out intake and exhaust of fluids, wherein the rotor unit includes a slide surface extending in an axial direction, the case includes a cylindrical projecting ring portion whose central axis is identical to that of the core and whose inner peripheral surface faces towards the central axis thereof, and the rotor unit contacts with and rotatably supported by the inner peripheral surface of the cylindrical projecting ring portion at the slide surface thereof.

2. The electric pump according to claim 1, wherein a space is formed within the case so as to house a motor driver portion.

3. The electric pump according to claim 1, wherein the rotor unit further includes a back yoke, which is of a cylindrical shape, and is fixed to an inner peripheral surface of the permanent magnet, the back yoke being directly rotatably supported by the inner peripheral surface of the cylindrical projecting ring portion at the slide surface that is formed on an outer peripheral surface of the back yoke, and that extends in an axial direction within a portion in which the back yoke is in a state of contact with the cylindrical projecting ring portion of the case.

4. The electric pump according to claim 3, wherein a space is formed within the case so as to house a motor driver portion.

5. The electric pump according to claim 1, wherein the rotor unit further includes a back yoke, which is of a cylindrical shape, and is fixed to an inner peripheral surface of the permanent magnet; wherein the case includes a hollow cylindrical portion whose central axis is identical to that of the core; and wherein the back yoke is rotatably supported by an inner peripheral surface of the hollow cylindrical portion at the slide surface that is formed on an outer peripheral surface of the back yoke, and that extends in an axial direction within a portion in which the back yoke is in a state of contact with the hollow cylindrical portion of the case.

6. The electric pump according to claim 5, wherein a space is formed within the case so as to house a motor driver portion.

7. The electric pump according to claim 5, wherein the rotor unit rotatably contacts a bottom surface of the hollow cylindrical portion at an end surface of the rotor unit.

8. The electric pump according to claim 5, wherein the outer rotor rotatably contacts a bottom surface of the hollow cylindrical portion at an end surface of the outer rotor.

9. The electric pump according to claim 1, wherein the case includes a hollow cylindrical portion whose central axis is identical to that of the core, and wherein the outer rotor is rotatably supported by an inner peripheral surface of the hollow cylindrical portion at the slide surface that is formed on an outer peripheral surface of the outer rotor.

10. The electric pump according to claim 9, wherein a space is formed within the case so as to house a motor driver portion.

11. The electric pump according to claim 9, wherein the rotor unit rotatably contacts a bottom surface of the hollow cylindrical portion at an end surface of the rotor unit.

12. The electric pump according to claim 9, wherein the outer rotor rotatably contacts a bottom surface of the hollow cylindrical portion at an end surface of the outer rotor.

13. The electric pump according to claim 9, wherein the outer rotor is fixed to an inner peripheral surface of the permanent magnet through a back yoke that is of a cylindrical shape.

14. The electric pump according to claim 13, wherein a space is formed within the case so as to house a motor driver portion.

* * * * *